United States Patent [19]

Fornasari

[11] Patent Number: 4,905,485

[45] Date of Patent: Mar. 6, 1990

[54] MULTIFUNCTION PNEUMATIC SYSTEM DESIGNED TO CONTROL DIFFERENT OPERATING COMPONENTS FOR DOMESTIC AND/OR INDUSTRIAL WASHING MACHINES

[75] Inventor: Paolo Fornasari, Casale Monferrato, Italy

[73] Assignee: Eltek S.p.A., Casale Monferrato, Italy

[21] Appl. No.: 264,593

[22] Filed: Oct. 31, 1988

[30] Foreign Application Priority Data

Oct. 29, 1987 [IT] Italy ..... 67912 A/87

[51] Int. Cl.[4] ..... D06F 33/10

[52] U.S. Cl. ..... 68/12 FA; 68/207; 68/17 R; 137/387; 137/624.18

[58] Field of Search ..... 68/12 R, 12 FA, 13 R, 68/17 R, 200, 207; 251/57, 61; 137/387, 624.13, 624.15, 624.18, 624.20, 625.11, 625.21, 625.46

[56] References Cited

U.S. PATENT DOCUMENTS

| | | | |
|---|---|---|---|
| 3,043,328 | 7/1962 | Taylor | 68/12 FA |
| 3,112,630 | 12/1963 | Anderson et al. | 68/12 FA |
| 3,237,529 | 3/1966 | Beck et al. | 68/12 FA |
| 3,256,696 | 6/1966 | Rice et al. | 68/12 FA |
| 3,363,438 | 1/1968 | Palmer | 68/12 FA |
| 3,367,152 | 2/1968 | Beck et al. | 68/12 FA |
| 3,375,686 | 4/1968 | Palmer | 68/12 FA |
| 4,450,696 | 5/1984 | Zukausky | 68/12 FA |

*Primary Examiner*—Frankie L. Stinson

*Attorney, Agent, or Firm*—Browdy & Neimark

[57] ABSTRACT

A multifunction pneumatic system designed to control different components for domestic and/or industrial washing machines. The system includes a pneumatic electric pump connected to a manifold from which solenoid valves, controlled by the machine timer are derived. The solenoid valves act by means of tubular conduits on corresponding diaphragm valves acting on different mechanisms such as the closing hook of the loading door, the electric switches, the pressure switch controlling the level of water in the machine tub and similar function.

5 Claims, 2 Drawing Sheets

A
40
B
41
45
54
48
44
53
47
43
52
46
49a
49b
58
50
51
42a
42
49
55
9
2
48
45
54
51
50
42
55
42a

MULTIFUNCTION PNEUMATIC SYSTEM DESIGNED TO CONTROL DIFFERENT OPERATING COMPONENTS FOR DOMESTIC AND/OR INDUSTRIAL WASHING MACHINES

BACKGROUND OF THE INVENTION

It is known from the present state of technology that electro-components such as: solenoid valves, pressure switches, loading door locks and relays associated with the machine timer are employed in household appliances, particularly in washing machines. The electric components, being supplied with ac. at 220 V, must be carefully structured in order to meet high safety standards to prevent possible hazards for the machine's operator; therefore they are expensive and consequently increase the cost of the machine.

SUMMARY OF THE INVENTION

Considering that the Applicant is the holder of U.S. Pat. No. 67883-A/87 having as an object a pneumatic device that replaces the well known solenoid valves, positioned directly downstream from the water inlet, the principal objective of the present invention is to provide a pneumatic system, particularly but not exclusively, for washing machines designed to control different operating components of the machine.

Another objective of the present invention is to provide a highly reliable pneumatic system having a simple mechanical structure and a limited cost.

Considering the objectives described the present system comprises a small membrane electric pump connected to a compressed air manifold from which a plurality of micro-solenoid valves powered by means of the machine timer are derived; said solenoid valves are angularly and pneumatically connected to pneumatic actuators associated with operating components controlling some phases of the machine washing cycle.

BRIEF DESCRIPTION OF THE DRAWINGS

Detailed characteristics of the system will be further described by way of example only, with reference to the accompanying schematic drawings, in which.

DETAILED DESCRIPTION OF THE EMBODIMENT

Figure 1:
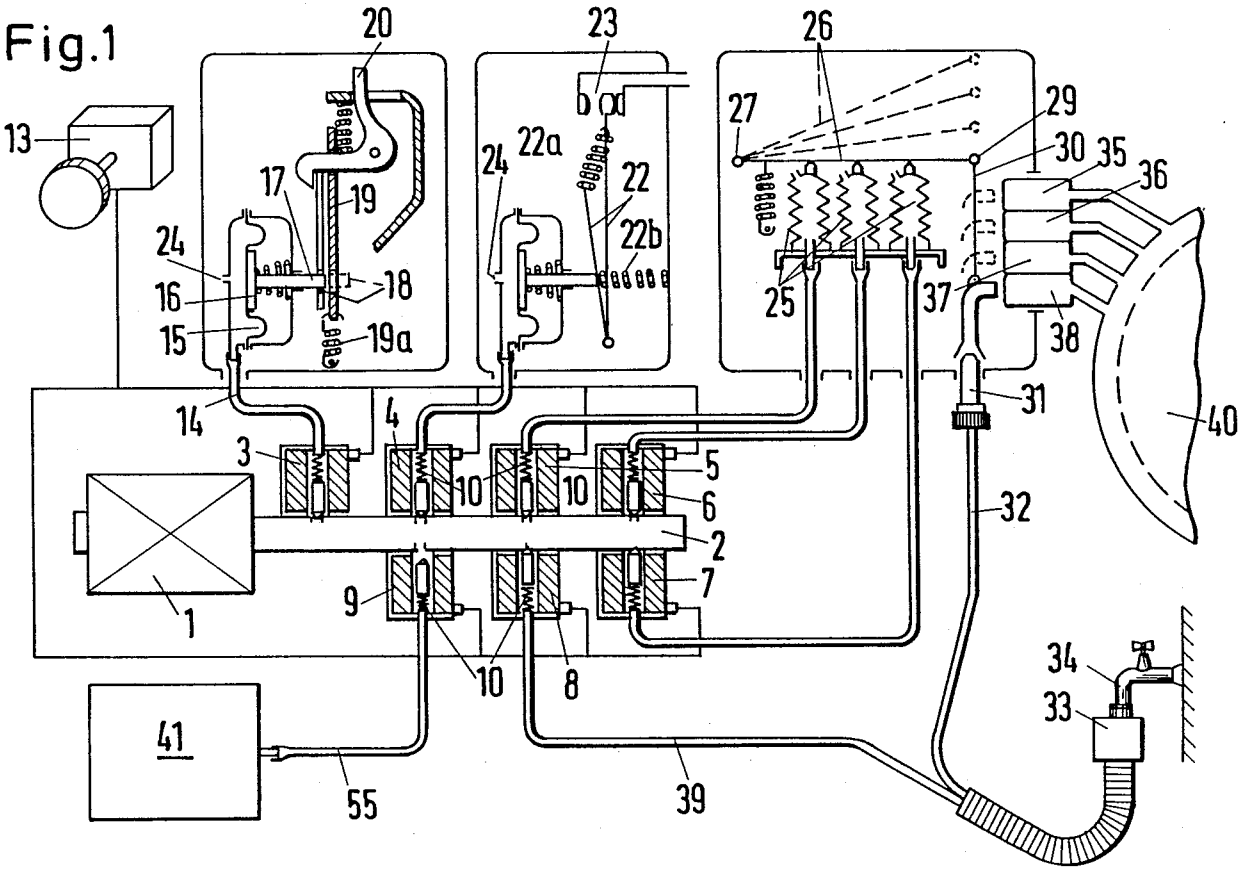
FIG. 1 is a schematic view illustrating the members of the system.

Referring to FIG. 1, 1 indicates a membrane electric pump of limited dimension, such as those employed for oxygenation of aquariums, connected to the tubular manifold 2 from which small needle solenoid valves 3,4,5,6,7,8,9 are derived, normally closed by the reaction of springs 10. Said solenoid valves are connected to the machine timer 13 by means of power supply circuit 11,12.

Solenoid Valve 3 by means of tubular conduit 14 is connected to the elastic diaphragm valve 15 and rigid plate 16 integral with stem 17, this latter able to engage the corresponding seat 18 of a sliding clasp 19, causing hook 20 that opens/closes the machine loading door to lock.

Solenoid valve 4, identical to valve 3, is pneumatically connected to valve 21 whose stem actuates bistable electric switch 22,23. The chambers comprising said valves are provided with exhaust passages 24 allowing excess air and compressed air to be bled and the return to the resting position of the various members, the machine and pump 1 being deactivated.

Solenoid valves 5,6,7 are pneumatically connected to three longitudinally expandible bellow elements 25, acting on an arm lever 26, pivoted at 27, associated with a spring 28. The opposite end of arm 26 is articulated to tie rod 30, connected to the water distributor 31, which by means of conduit 32 and one or two pneumatic valves schematically indicated at 33, is connected to faucet 34,35,36,37,38 indicate the dispensers containing different agents to be used for: prewashing, washing, starching and bleaching.

Figures 2, 3:
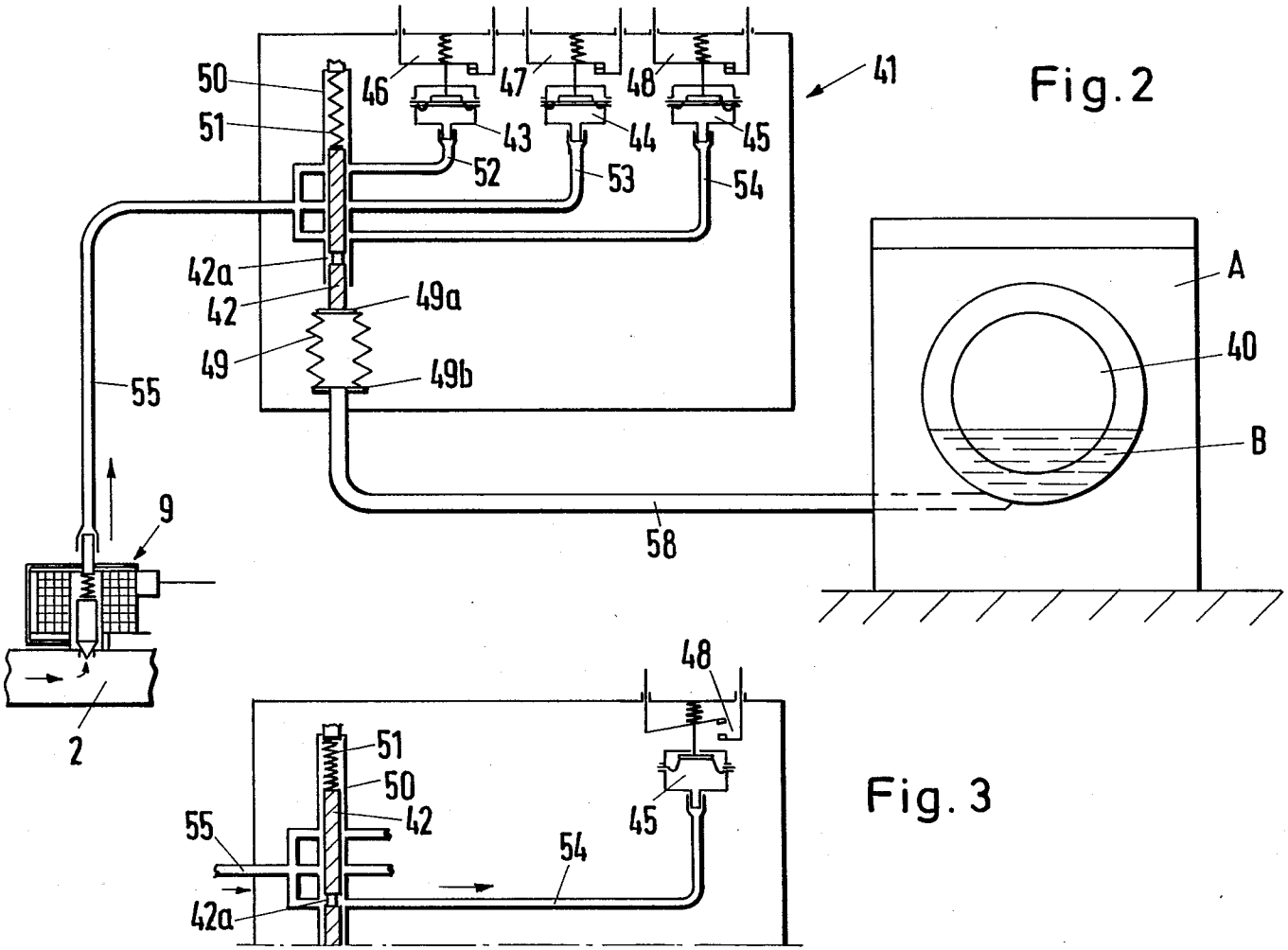
FIG. 2 is a detailed view of the component part replacing the pressure switch member.
FIG. 3 is a detailed view of FIG. 1.

Solenoid valve 8 by means of tube 39 is connected to the set of pneumatic valves 33 (object of the above mentioned patent in the name of the same Applicant). 40 indicates the machine tube, 41 illustrates the whole unit schematically illustrated in FIG. 2.

Solenoid valve 9 by means of sealing switch 42 sliding in seat 50 and derived conduits 52,53,54 leads to three pneumatic plate valves 43,44,45 whose stems cause corresponding electric switches respectively 46,47,48 to open, against the reaction of calibrated springs.

Switch 42 sliding in the tubular coupling 50 against the reaction of calibrated spring 51, is provided with a diametral throat or passage 42a for the air. A closed end **49*a* of an elastic bellow 49 is connected to the base of switch 42; the opposite end 49*b* has a seal connection with the tubular branch 58, allowing the internal part of bellow 49 to communicate with the inside of tub 40** of the machine A.

The tubular branch 55 (FIGS. 1,3) connects valve 9 and manifold 2 to the sliding switch 42, **42*a* jointed to the derived tubular branches 52, 53,54 that lead respectively to pneumatic valves 43,44,45**. The operation of the device is the following:

When the machine is powered, pump 1 is activated; the compressed air generated by the same enters manifold 2; valves 3. to 9 are closed; the sequential opening of the same and/or the simultaneous opening of two or more valves is governed by the timer 13 which excites the corresponding coils. The now open valves move from position of valves 3..to 8, FIG. 1 to position of valve 9. Valves 8,9 are opened by activating the machine. Valve 8 by means of conduit 39 causes valves 33 to open allowing the water inflow through conduit 32 and distributor 31. Water enters tub 40. Electric switches 46,47,48 are closed. Water -B- in tub 40 generates a pneumatic pressure in conduit 52 which, by means of bellow 49 causes switch 42 to slide. The opening of conduits 54,53 or 52 caused by the air pressure interrupts the power supply circuits including said switches. Timer 13 for example, closes the water inflow into tub 40. The opening control of valve 3, FIG. 1 causes the pneumatic valve to be activated and hook 20 to lock. Said hook may be released by the reaction of spring **19*a*, when valve 3 closes again and compressed air bleeds from valve 15,16 through exhaust passage 24. The door controlled by hook 20 will be opened later with respect to the stopping of the machine, owing to the slow bleed of compressed air through exhaust passage 24, thereby preventing the operator from having access inside the machine when still powered, because pump 1 is energized and respectively deenergised by means of the machine general switch. Analogously the activation of pneumatic valve 21 forces the switch or bistable relay 22 to exchange the opposited contacts owing to a considerable compressed air pressure, against the reaction of springs 22***a*, 22*b*, that make it snap back to the initial position, when the pressure of compressed air ceases. Remarkable advantages derive from the rapid closing and/or opening of the switch contacts because of the strong pressure generated by the compressed air and the reaction of the return springs.

The opening of valves 5,6,7, conveys compressed air to bellows 25 causing the angular movement of lever 26. Owing to the different distance of bellows with respect to fulcrum 27 of lever 26, the latter is subjected to a differential angular movement that causes the distributor outlet 31 to coincide with either dispensers 35 to 38.

The advantages of utilizing the system described above can be summarized as follows:

Elimination of electrical connections near the water points, which are anyhow positioned far from operator's manoeuvring points.

Replacement of a plurality of electrical members with reliable and low cost valves;

Replacement of the normal pressure switch with an extremely sensitive hydropneumatical device.

Use of a low cost electric vibrator pump having limited dimensions;

Considerable saving and functional reliability of the whole unit.

The invention is not limited to the description referred to the schematic drawings herewith annexed by way of example only. The ambits of the patent comprise any other solution of the device with regards to the electric and hydraulic component part as well as to the structure and the arrangements of the different components

I claim:

1. A multifunction pneumatic system for controlling operating components of washing machines, comprising:

at least one pneumatic electric pump;

at least one pneumatic valve associated with the operating components of the washing machines;

at least one pneumatic conduit connecting said at least one pneumatic electric pump to said at least one pneumatic valve;

elastic calibrated means for biasing the action of said at least one pneumatic valve, the operating components reacting against the elastic calibrated means;

water distributor means selectively controllable to activate individually various ones of the components; and at least one bellows element connected to said at least one pneumatic valve by at least one compressed air conduit and operatively connected to said water distributor means for causing said water distributor means to selectively activate individual ones of the components which thereby empty into a tub of the washing machine.

2. The pneumatic system as claimed in claim 1, further comprising a manifold connected to said at least on pneumatic electric pump and to said at least one pneumatic valve, pneumatically connected to corresponding pneumatic components able to generate movements transmitted to the operating components of the washing machine, against the reaction of said elastic calibrated means, and electrically connected to a machine timer.

3. The pneumatic system as claimed in claim 1, further comprising electric switches actuated by air pressure valves, and relays connected to said electric switches for controlling electrothermic devices, a power supply for the washing machine or the at least one pneumatic electric pump.

4. The pneumatic system as claimed in claim 1, further comprising:

a sliding switch;

a bellows connected via a conduit to the tub and associated with said sliding switch;

three electric switches for controlling three different levels of water in the tub, wherein said sliding switch selectively opens, under air pressure, said electric switches to control the level of water.

5. The pneumatic system as claimed in claim 1, wherein each of said at least one pneumatic valves comprises an electric winding, a conic end plunger coaxially and slidingly contained within said electric winding, and a calibrated spring for biasing said plunger for shutting in an outflow passage.

* * * * *